US005284497A

United States Patent [19]

Egiebor et al.

[11] Patent Number: 5,284,497

[45] Date of Patent: Feb. 8, 1994

[54] DESULFURIZATION OF SOLID CARBONACEOUS FUELS BY COAGGLOMERATION WITH SULFUR SORBENTS

[75] Inventors: Nosa O. Egiebor, Edmonton; Joshua U. Otaigbe, Grande Prairie, both of Canada

[73] Assignee: Alberta Oil Sands Technology and Research Authority, Edmonton, Canada

[21] Appl. No.: 838,916

[22] Filed: Feb. 21, 1992

Related U.S. Application Data

[63] Continuation-in-part of Ser. No. 597,800, Oct. 10, 1990, abandoned.

[51] Int. Cl.[5] ..... C10L 9/10; C10L 9/00

[52] U.S. Cl. ..... 44/561; 44/559; 44/569

[58] Field of Search ..... 44/569, 561

[56] References Cited

U.S. PATENT DOCUMENTS

| | | | |
|---|---|---|---|
| 4,302,207 | 11/1981 | Paspek | 44/559 |
| 4,515,601 | 5/1985 | Charters | 44/530 |
| 4,661,119 | 4/1987 | Andersson et al. | 44/10 C |
| 4,661,240 | 4/1987 | Kessick et al. | 44/15 R |

FOREIGN PATENT DOCUMENTS

| | | | |
|---|---|---|---|
| 7339447 | 5/1975 | France | 44/561 |

*Primary Examiner*—Ellen M. McAvoy
*Attorney, Agent, or Firm*—Bacon & Thomas

[57] ABSTRACT

A solid carbonaceous fuel having reduced sulfur dioxide emission upon combustion is provided. The fuel comprises a coagglomerate formed of coke or coal, a novel silica-enhanced sulfur-dioxide sorbent and a bitumen binder.

14 Claims, 4 Drawing Sheets

DESULFURIZATION OF SOLID CARBONACEOUS FUELS BY COAGGLOMERATION WITH SULFUR SORBENTS

This is a continuation in part application of application Ser. No. 07/597,800 filed Oct. 10, 1990, now abandoned.

FIELD OF THE INVENTION

The present invention relates to a solid carbonaceous fuel having reduced sulfur dioxide emission upon combustion.

BACKGROUND OF THE INVENTION

In the northern regions of Alberta, Canada, are oil sands from which bitumen is extracted using a hot water extraction process and upgraded using a hydroconversion process. Deleteriously, the sulfur content of the produced coke is high, of the order of 6–9% wt. Thus, when such coke is combusted, the sulphur dioxide emissions are above permissible limits, rendering the coke useless as a solid fuel. Since 1975, researchers have unsuccessfully sought methods of reducing the sulfur dioxide released upon the combustion of the cokes produced by the refinery. Unfortunately, up to the present time the coke, which is useless, is stockpiled until such time that a treatment process is arrived at.

Various processes for the control of sulfur dioxide emissions during petroleum coke combustion have been disclosed in the literature and patents. Exemplary disclosures would include those of U.S. Pat. No. 4,302,207 or U.S. Pat. No. 4,515,601.

The '207 patent issued to S. C. Paspek, teaches the use of an aqueous gelling agent with coal and a calcium-containing compound as a sulphur getter. The utilization of an aqueous component inherently will result in a lowered fuel efficiency in comparison to using a non-aqueous gelling agent.

The '601 patent issued to J. E. Charters discloses briquette agglomerates formed from pulverized coke, sand, dolomite, clay and asphaltene. Bentonite is used as the binding agent. However, dolomite has the disadvantage of being difficult to grind, and a proportionately large amount would be required in order to provide effective sulfur capture.

It is to be noted, however, that the sulfur capture efficiency of the fuels produced from either of the above teachings, deleteriously, would only range between 9 to 75% at combustion temperatures ranging between 500° C. to 800° C.

There exists, therefore, always, the requirement to find a fuel having a higher sulfur capture efficiency at the temperatures at which conventional furnaces are operated, namely between 700° C. and 800° C.

Additionally, the disadvantages of many of these prior art processes are that they are not considered to be sufficiently economically attractive for use on a commercial scale.

Along somewhat different lines, though of relevance to the background of the instant invention, it is known in the art to form coke or coal agglomerates. Such agglomerates have been prepared using 'wet' techniques wherein water, bitumen (and/or an alternative liquid hydrocarbon) and coke are admixed. These formed agglomerates, following separation from the water, may then be used as fuel. The disadvantages of these prior art agglomeration techniques are that very large amounts of water and extensive agitation are required to prepare the agglomerates. Furthermore, agglomerates thus formed are not easily handled, exhibiting mechanical instability and the like. It would be advantageous, therefore, to provide an agglomeration process which would yield mechanically stable agglomerates and avoid the use of water.

SUMMARY OF THE INVENTION

In accordance with the present invention, there is provided a novel carbonaceous fuel having reduced sulfur dioxide emission upon combustion.

More specifically, the invention provides a solid carbonaceous fuel comprising a coagglomerate of coke or coal, a novel silica-enhanced sulfur sorbent and a hydrocarbon binder. The coke typically comprises a high sulfur-content coke or coal like that produced from the bitumen upgrading process. The silica-enhanced sulfur sorbents is those synthesized by the pressure hydration of a specific ratio of siliceous material or coal fly-ash together with lime. The mole ratio of $Ca(OH)_2/SiO_2$ ranges from 0.5 to about 2.0.

The novel silica-enhanced sulfur sorbent formed by the pressure hydration of lime and coal fly-ash or silica, is a) $CaSiO_3H_2O$ which is a hydrated calcium silicate; and b) $Ca_3\ Al_2\ (SiO_4)\ (OH)_8$ which is a hydrated calcium alumina-silicate.

Without being bound by same, it is believed that calcium silicate forms on the sand, thereby increasing the surface area thereof.

This particular sulfur sorbent, advantageously, exhibits a very high sulfur capture efficiency. The sulfur capture efficiency of a coagglomerate containing the novel silica-enhanced sorbent ranges between 45% to 90% at combustion temperatures ranging between 100° C. and 600° C. respectively. And, the sulfur capture efficiency of the formed coagglomerate in the 700° C. to 800° C. range exceeds 85%.

Further advantages reside in the fact that the formed coagglomerates exhibit desirable mechanical strength properties which much facilitates handling thereof. Additionally, following combustion, the agglomerates do not form dust, but sand which can be easily removed and managed. Furthermore, the agglomerates are highly efficient in sorbing sulfur, without having the sulfur sorbent occupying a significant volume of the coagglomerate.

In the instance where the coke is that provided from bitumen, extra advantages arise because the residual sand starting material provided by the hot water extraction process is clean and available in abundance. Another economic advantage resides in the ready availability in the refinery of low pressure steam. The bitumen used as the binder again is easily obtained and its use involves no further expense.

In summary, by forming the above-described coagglomerates, a coke that otherwise was of no use can be converted to a viable and combustible fuel.

In a broad aspect the invention relates to a solid carbonaceous fuel having reduced sulfur dioxide emission upon combustion which comprises a coagglomerate formed of particulate coke or coal, a silica-enhanced sulfur sorbent, prepared by the pressure hydration of lime and silica or coal-fly ash, wherein the mol ratio of $Ca(OH)_2/SiO_2$ ranges from about 0.5 to about 2.0, and a hydrocarbon binder. More specifically, the sulfur sorbent is $CaSiO_3$ $Ca_3Al_2(SiO_4)(OH)_8$.

DESCRIPTION OF PREFERRED EMBODIMENT

Figure 1:
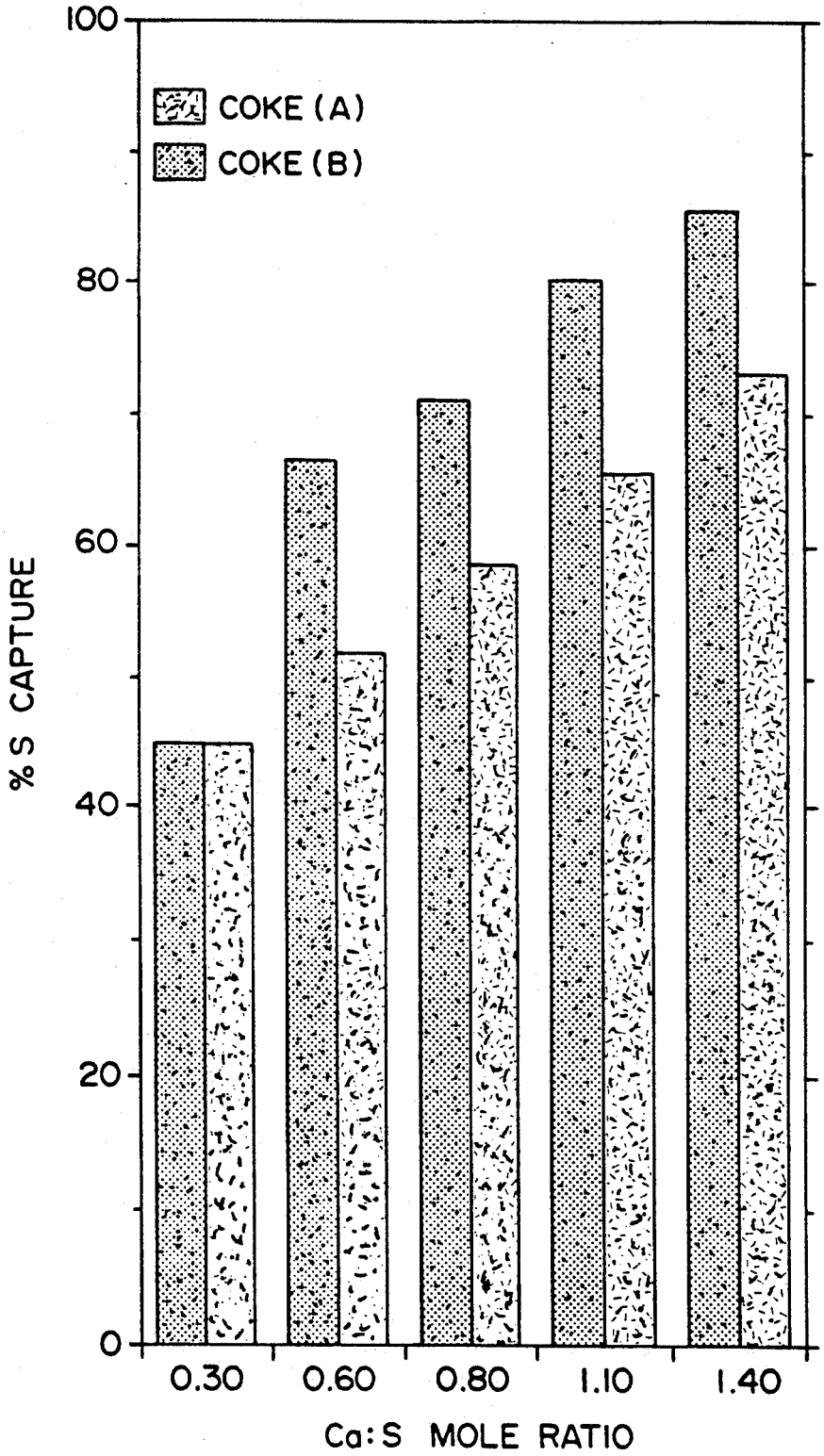
FIG. 1 is a histogram illustrating the % sulfur capture versus the Ca:S mole ratio type (a) coke and type (b) coke coagglomerates wherein the sulfur sorbent is a calcium silicate hydrate prepared from $Ca(OH)_2$ and Lane Mountain silica sand and the combustion temperature is 800° C.
Figure 2:
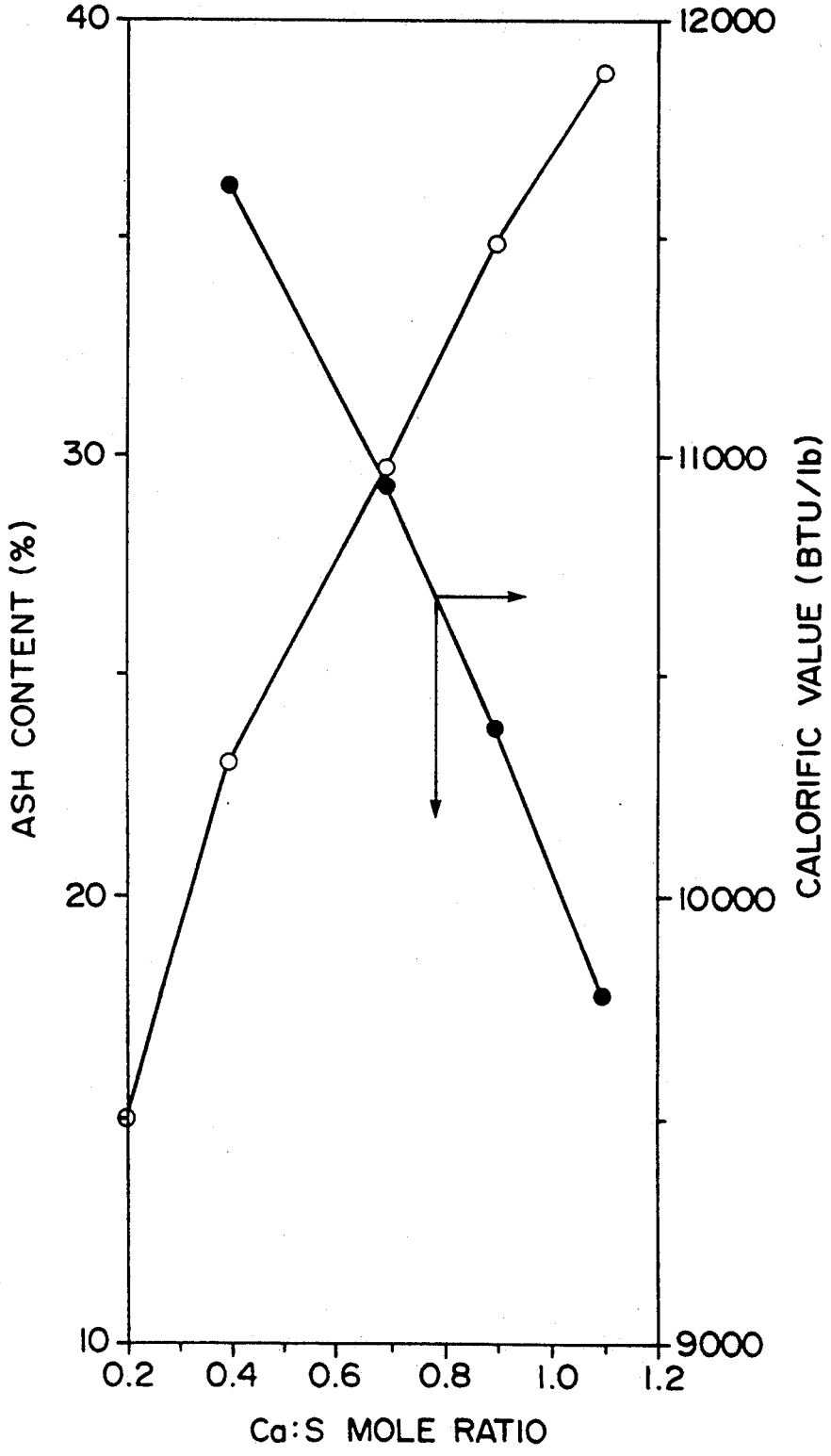
FIG. 2 is a plot of the % ash content and calorific values versus Ca:S mole ratio for type (a) coke using an activated sulfur sorbent prepared from $Ca(OH)_2$ and coal fly-ash.
Figure 3:
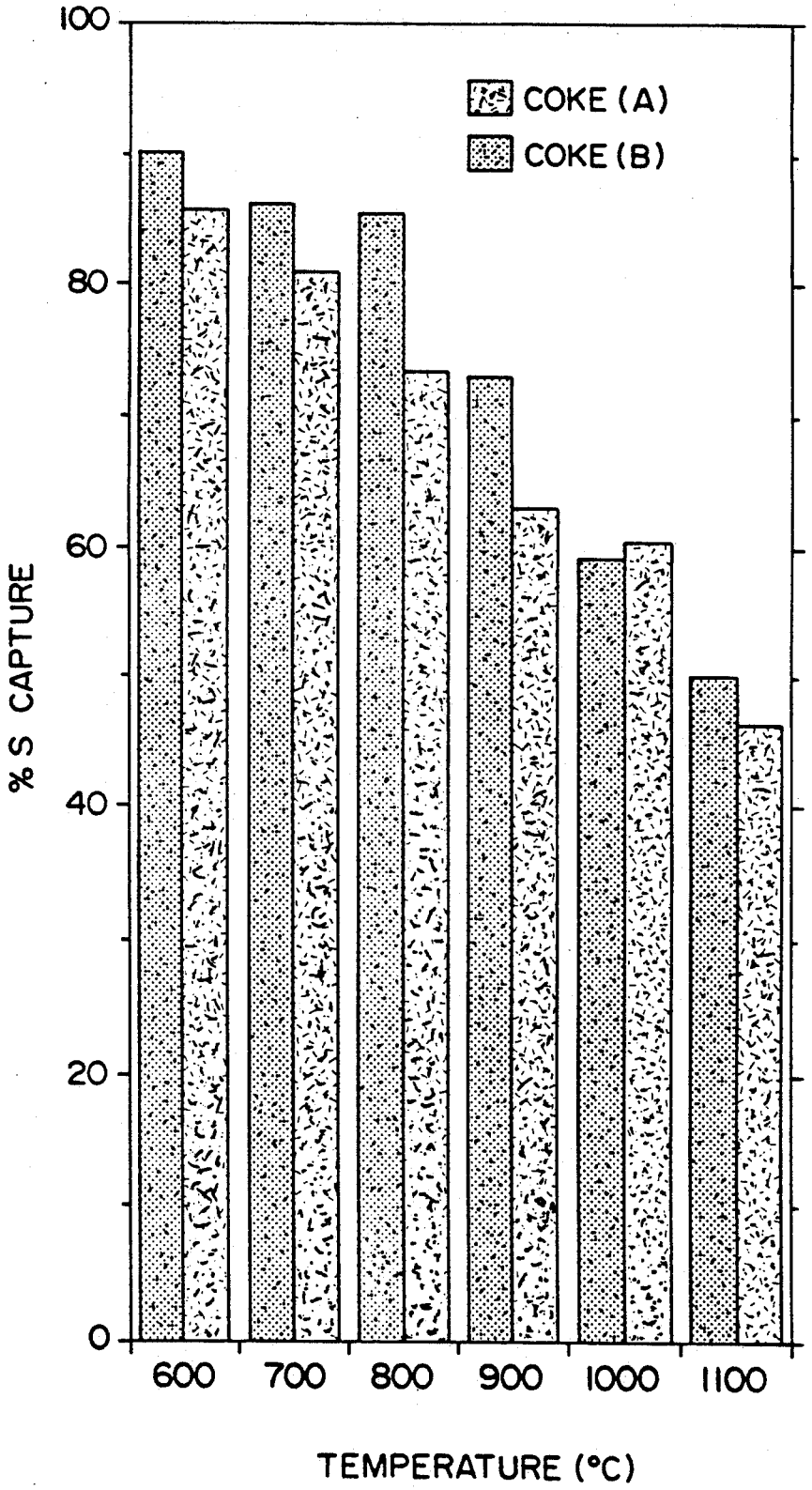
FIG. 3 is a histogram depicting the effect of combustion temperature on the sulfur capture activity wherein the sulfur sorbent and coke types are the same as those described for FIG. 1 supra.
Figure 4:
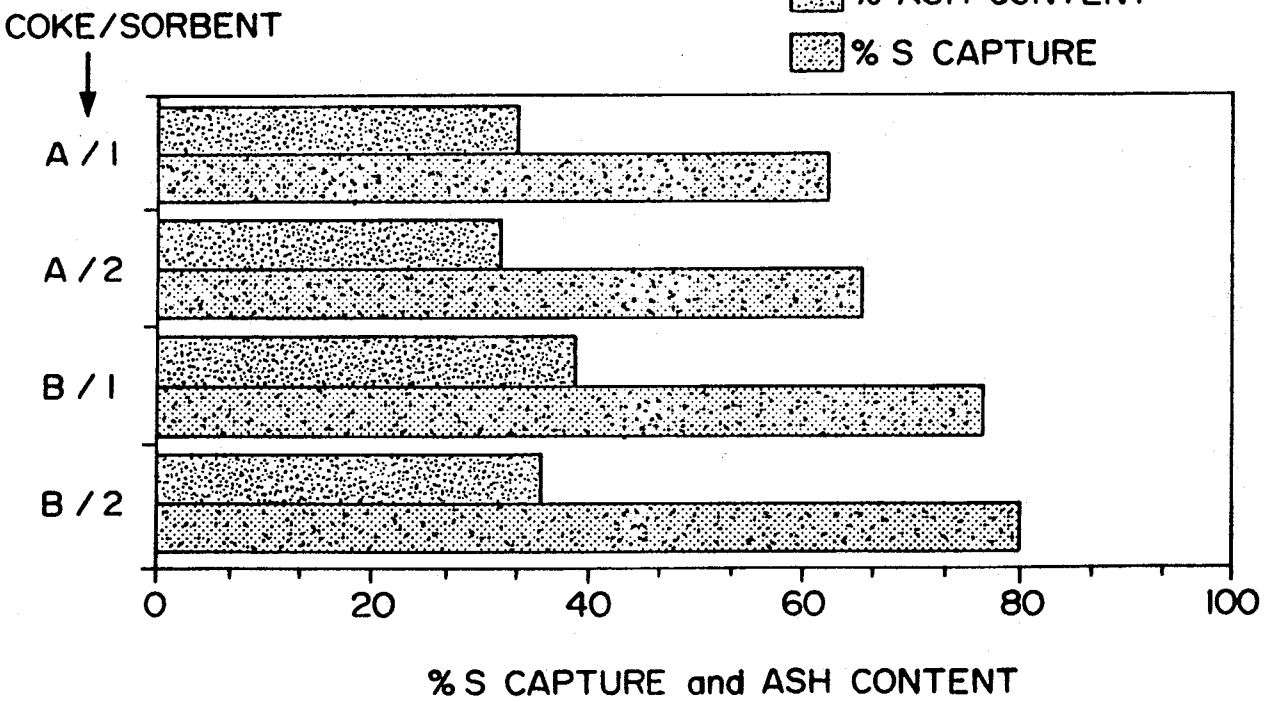
FIG. 4 provides a comparison of the % sulfur capture and ash content for the coke types and sulfur sorbents tested.

The coke used in the preparation of the 'dry' coagglomerates of the present invention can comprise coke or sulfur-containing coal.

Preferably, the coke is a coke derived from the upgrading of bitumen characterized by having a high sulfur content ranging from 5-10% wt. The coke is ground to a powder having a particle size ranging from 180-212 microns.

The sulfur sorbents employed in the practice of the present invention include 'activated' or 'silica-enhanced' sulfur sorbents. These latter sorbents are prepared by the pressure hydration of pure silica or coal fly-ash and lime. The pressure hydration technique will be described hereinafter. The ratio of sulfur sorbent to coke, or coal is less than or equal to 5% (w/w).

The binder comprises any suitable liquid hydrocarbon. Preferably, the hydrocarbon oil is bitumen. A minimal amount of bitumen binder is used. Typically, the amount utilized is of the order of 0.5-10%, preferably less than 5% based on the weight of coke.

The coke and sulfur sorbent are first dry mixed using a shaker until a homogenous mixture was obtained. The bitumen binder is then added and the mixing continued until dry agglomerates having Ca:S mole ratios ranging from 0 to 1.4 were obtained.

EXPERIMENTAL

Suncor delayed and Syncrude fluid coke samples, (hereinafter referred to a type (a) and type (b) coke respectively), were obtained from Suncor Limited and Syncrude Limited, both of Alberta, Canada, respectively. Reagent grade $Ca(OH)_2$ was used. The tailings sands (Lane Mountain silica sand, 99.6 wt % $SiO_2$) and coal fly-ash (64 wt. % $SiO_2$) (sorbents 1 and 2) were obtained from Lane Mountain Silica Company, Washington and TransAlta Utilities, Alberta, respectively. Table I given herebelow illustrates certain properties of Suncor (type a) and Syncrude (type b) coke.

TABLE I

| Property | Type (a) | Type (b) |
|---|---|---|
| Sulfur Content (%) | 6.76 | 7.61 |
| Calorific Value ($MJkg^{-1}$) | 31.9 (13,760 BTU $lb^{-1}$) | 29.8 (12,897 BTU $lb^{-1}$) |

TABLE I-continued

| Property | Type (a) | Type (b) |
|---|---|---|
| Ash Content (%) | 5.0 | 8.6 |

The coke and sorbent materials were used in the form of powder, with particle sizes in the range of 180 to 212 microns. Cold Lake bitumen was used as a binder.

The silica-enhanced (or "activated") sorbents were prepared by batch pressure hydration of the siliceous material (i.e. sorbents 1 or 2) and $Ca(OH)_2$ followed by drying to constant weight. A stainless steel pressure reactor of 300 ml capacity was used as the hydrator. The dry siliceous material and $Ca(OH)_2$ were placed into the cold pressure sampling cylinder. The injection valve in the line connecting the sampling cylinder with the hydrator was closed, and the sampling cylinder was pressurized to 100 psi higher than the vapour pressure of water at a temperature of 150° C. The pressure hydrator was then heated electrically, controlled by a thermocouple inside the reactor. When the temperature reached 150° C., the injection valve was opened and water was instantaneously injected from the sampling cylinder into the hydrator. Throughout the hydration period, of one hour, the contents of the hydrator were vigorously stirred. After the water injection was completed (monitored by the pressure gauge), the injection valve was closed and the sampling cylinder disconnected. The water to solids ratio in the hydrator was maintained at 15:1 throughout. On expiration of the hydration time, the hydrator was depressurized via steam release through the injection valve. The powdery sample was then filtered by means of a Buchner funnel and dried to constant weight in a vacuum oven at 85° C. The morphology and composition of the sorbents were characterized using scanning electron microscopy (SEM) coupled with an energy dispersion system and X-ray diffractometer (XRD).

Table II shown herebelow provides X-ray diffraction data for dry-mixed $Ca(OH)_2/SiO_2$ and pressure hydrated silica-enhanced sorbents at a $Ca(OH)_2/SiO_2$ molar ratio of 1.0 (Cu K radiation and Ni filter).

TABLE II

| Sample | 2 0(°) | d-Spacing (A) | Rel. Int. (%) | Identified Phase |
|---|---|---|---|---|
| $Ca(OH)_2/SiO_2$[a] | 18.0 | 4.90 | 74 | $Ca(OH)_2$ |
| | 28.8 | 3.10 | 23 | |
| | 34.2 | 2.62 | 100 | |
| | 47.2 | 1.92 | 42 | |
| | 26.6 | 3.34 | 100 | $SiO_2$ |
| | 51.0 | 1.79 | <1 | |
| F-Ash-CSH | 27.2 | 3.26 | 23 | $Ca_3Al_2(SiO_4)(OH)_8$ |
| | 35.8 | 2.50 | 19 | |
| | 37.2 | 2.41 | 26 | |
| | 40.2 | 2.24 | 58 | |
| | 45.6 | 1.99 | 64 | |
| | 18.0 | 4.90 | 74 | $Ca(OH)_2$ |
| | 34.0 | 2.63 | 100 | |
| | 47.2 | 1.92 | 42 | |
| | 21.0 | 4.25 | 35 | $SiO_2$ |
| | 26.6 | 3.34 | 100 | |
| | 50.2 | 1.81 | 17 | |
| L-MT-CSH | 39.6 | 2.26 | 100 | probably —$CaSiO_3 \cdot H_2O$ |
| | 46.0 | 1.97 | 50 | |
| | 67.9 | 1.38 | 50 | |
| | 18.0 | 4.90 | 74 | $Ca(OH)_2$ |
| | 34.0 | 2.63 | 100 | |
| | 47.2 | 1.92 | 42 | |
| | 20.9 | 4.25 | 35 | $SiO_2$ |
| | 26.8 | 3.33 | 100 | |

TABLE II-continued

| Sample | 2 0(°) | d-Spacing (A) | Rel. Int. (%) | Identified Phase |
|---|---|---|---|---|
| | 50.2 | 1.81 | 17 | |

Note:
[a]Dry physical mixture of $Ca(OH)_2/SiO_2$ at a molar ratio of 1.0

The ash content and the calorific values were determined according to ASTM D 3174-82 and ASTM D 3286-77 respectively. Sulfur dioxide emission from the coke agglomerates was determined by burning about 0.2 g of the sample in a stream of oxygen at 800° C. using a modified ASTM D 3177-75 method described previously. The percent sulfur in the sample was calculated from the equation:

$$\% S = \frac{1.603 \times 0.05 \times \text{volume}}{\text{weight of sample}}$$

The sulfur "fixed" in the ash after combustion was expressed as a percentage of the total sulfur in the original sample and reported as percent sulfur capture.

The embodiments of the invention in which an exclusive property or privilege is claimed are defined as follows:

1. A solid carbonaceous fuel having reduced sulfur dioxide emission upon combustion which comprises a coagglomerate formed of particulate coke or coal, a silica-enhanced sulfur sorbent comprising $CaSiO_3H_2O$ and $Ca_3Al_2(SiO_4)(OH)_8$ and a hydrocarbon binder.

2. The fuel as set forth in claim 1 wherein the ratio of said silica-enhanced sorbent to coke, or coal, ranges from between about 0.2% to about 10% (w/w).

3. The fuel as set forth in claim 2 wherein the ratio of said silica-enhanced sorbent to coke, or coal, is less than 5% (w/w).

4. The fuel as set forth in claim 3, wherein the hydrocarbon binder is bitumen.

5. The fuel as set forth in claim 4 wherein said bitumen is less than about 10% based on the weight of coke or coal.

6. A fuel as set forth in claim 1, wherein the said coal or coke is coke derived from the upgrading of bitumen.

7. A fuel as set forth in claim 1, in which the said coal or coke has a particle size in the range of about 180 microns to about 212 microns.

8. A solid carbonaceous fuel having reduced sulfur dioxide emission upon combustion which comprises a coagglomerate formed of particulate coke or coal, a silica-enhanced sulfur sorbent and a hydrocarbon binder, said silica-enhanced sulfur sorbent being a compound prepared by the pressure hydration of lime in admixture with silica or coal fly-ash, wherein the mol ratio of $Ca(OH)_2/SiO_2$ ranges from about 0.5 to about 2.0.

9. The fuel as set forth in claim 8 wherein the ratio of silica-enhanced sorbent to coke, or coal, ranges from between about 0.2% to about 10% (w/w).

10. The fuel as set forth in claim 9 wherein the ratio of silica-enhanced sorbent to coke, or coal, is less than 5% (w/w).

11. The fuel as set forth in claim 10, wherein the hydrocarbon binder is bitumen.

12. The fuel as set forth in claim 11 wherein said bitumen is from 0.5% to 10% based on the weight of coke or coal.

13. A fuel as set forth in claim 8, wherein the said coal or coke is coke derived from the upgrading of bitumen.

14. A fuel as set forth in claim 8, in which the said coal or coke has a particle size in the range of about 180 microns to about 212 microns.

* * * * *